US007918448B2

(12) United States Patent
Suzuki et al.

(10) Patent No.: US 7,918,448 B2
(45) Date of Patent: Apr. 5, 2011

(54) SHEET SUPPLYING DEVICE AND IMAGE FORMING SYSTEM

(75) Inventors: Tomoo Suzuki, Machida (JP); Kazuyoshi Kimura, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 298 days.

(21) Appl. No.: 11/359,668

(22) Filed: Feb. 22, 2006

(65) Prior Publication Data

US 2006/0267270 A1 Nov. 30, 2006

(30) Foreign Application Priority Data

May 30, 2005 (JP) ..... 2005-156972

(51) Int. Cl.
*B65H 1/00* (2006.01)

(52) U.S. Cl. ..... 271/171; 271/145

(58) Field of Classification Search ..... 271/171, 271/145, 223, 226

See application file for complete search history.

(56) References Cited

U.S. PATENT DOCUMENTS

| | | | | | |
|---|---|---|---|---|---|
| 4,007,925 | A | * | 2/1977 | DeRyke et al. | 271/160 |
| 4,874,160 | A | * | 10/1989 | Yamamoto | 271/227 |
| 5,114,133 | A | * | 5/1992 | Osada et al. | 271/22 |
| 5,286,018 | A | * | 2/1994 | Rasmussen et al. | 271/147 |
| 5,536,000 | A | * | 7/1996 | Kelly | 271/189 |
| 6,014,229 | A | * | 1/2000 | Yun | 358/449 |
| 6,728,509 | B2 | * | 4/2004 | Cornelius | 399/393 |

FOREIGN PATENT DOCUMENTS

| | | | | |
|---|---|---|---|---|
| JP | 63-161235 | U | | 10/1988 |
| JP | 03297738 | A | * | 12/1991 |
| JP | 8-106187 | A | | 4/1996 |
| JP | 10-258946 | A | | 9/1998 |
| JP | 11-59925 | | | 3/1999 |
| JP | 11-217123 | A | | 8/1999 |
| JP | 11217123 | A | * | 8/1999 |
| JP | 2002-240965 | A | | 8/2002 |
| JP | 2003182860 | A | * | 7/2003 |

OTHER PUBLICATIONS

Office Action for Japanese Patent Application No. 2005-156972 mailed Oct. 6, 2009 with English translation.

* cited by examiner

*Primary Examiner* — Stefanos Karmis
*Assistant Examiner* — Ernesto Suarez
(74) *Attorney, Agent, or Firm* — Cantor Colburn LLP

(57) ABSTRACT

A sheet supplying device, including a sheet stacking member which can stack various sized sheets, a side edge alignment member which moves perpendicular to a sheet supplying direction and aligns at least one of side edges of the stacked sheets placed on the sheet stacking member, and an auxiliary side edge alignment member which is provided on the side edge alignment member and ejects in a moving direction of the side edge alignment member and which aligns stacked sheets whose width is narrower than that of the stacked sheets which are to be aligned by the side edge alignment member.

9 Claims, 6 Drawing Sheets

FIG. 7 (a) CONVENTIONAL ART
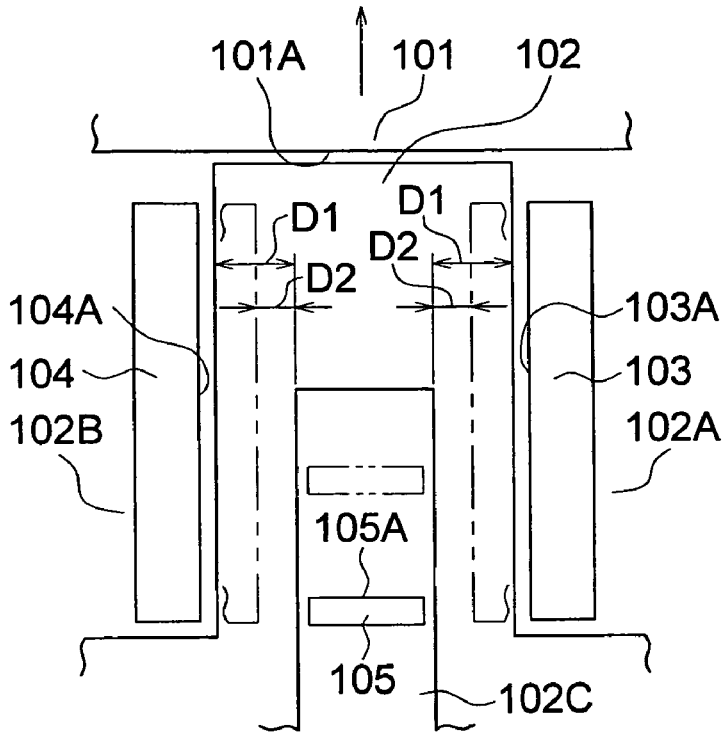
FIG. 7 (b)
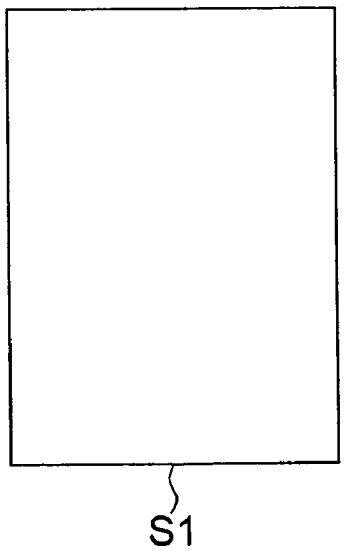
FIG. 7 (c)
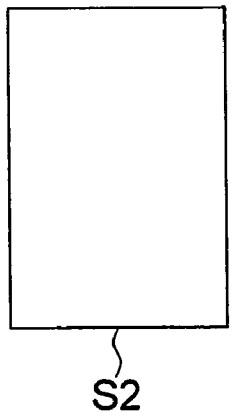

SHEET SUPPLYING DEVICE AND IMAGE FORMING SYSTEM

This application is based on Japanese Patent Application No. 2005-156972 filed on May 30, 2005 in the Japanese Patent Office, the entire content of which is hereby incorporated by reference.

BACKGROUND OF THE INVENTION

The present invention relates to a sheet supplying device which is able to stack various sized sheets, and to an image forming system in which the sheet supplying device is connected to an image forming apparatus.

A sheet supplying cassette to stack predetermined amounts of sheets is typically provided in image forming systems, such as copying machines and printers, for supplying such sheets. While, for supplying a large number of sheets, a stack of 1000 sheets, for example, a sheet supplying device, being able to stack such a large number of sheets, is connected to a side of the image forming apparatus, whereby the sheets are supplied from this sheet supplying device into the image forming apparatus.

The sheet supplying device comprises a sheet stacking member to stack various sizes of sheets, and which is movable vertically, and alignment members which are movable for positioning the stacked sheets at the proper position for each size of sheets. For positioning the various sizes of sheets in the sheet supplying direction, the edge of the top of a stack of sheets comes into contact with a holding member, such as the interior surface of the sheet supplying device, while the ends of the stacked sheets are aligned by an end edge alignment member, movable in the sheet supplying direction. Further, side edge alignment members are provided to perpendicularly align both sides of the stacked sheets in the sheet supplying direction, and when one of the side edge alignment members is moved, the other member is also driven in conjunction with the former in the opposite direction, whereby the various sized sheets are positioned with their centers being equal each other. In addition, sheet alignment members are known which can be replaced by an operator.

Whichever may be used in the above cases, the end edge alignment member and the side edge alignment member are provided in the sheet supplying device to move horizontally to the sheet stacking member, and both members regulate the position of the stacked sheets from the lowest sheet to the highest sheet. Now, the fundamental sections of the conventional sheet supplying device will be shown in FIG. 7(*a*).

In FIG. 7(*a*), sheet stacking member 102 installed in image forming apparatus 101 is able to stack various sizes sheets, and sheet stacking member 102 moves vertically. A sheet stacked in sheet stacking member 102 is conveyed into the image forming apparatus as shown by the arrow. At both sides of sheet stacking member 102, being perpendicular to the conveyance, large empty spaces 102A and 102B are provided, through which side edge alignment members 103 and 104 are extended and move perpendicularly to the sheet conveyance direction. Further, side edge alignment members 103 and 104 move opposite to each other so that interior wall 103A of side edge alignment member 103 and interior wall 104A of side edge alignment member 104 regulate the side edges of the stacked sheets perpendicularly to the sheet conveyance direction.

Further, concerning the sheet conveyance direction, the top edge of the stacked sheets comes into contact with interior wall 101A of image forming apparatus 101. Since large long cavity 102C is formed in sheet stacking member 102, end edge alignment member 105 is ejected through long cavity 102C, and can move in the sheet conveyance direction and reverse to it. Then interior wall 105A of end edge alignment member 105 aligns the end edge of the stacked sheets.

As described above, side edge alignment members 103 and 104 as well as end edge alignment member 105 shown in FIG. 7(*a*) regulate sheets S1 which is B5 sized sheets and placed longwise, shown in FIG. 7(*b*).

In order to stack small-sized sheets, such as post cards shown in FIG. 7(*c*), it is necessary that sheet side edge regulating members 103 and 104 are shifted to the inner positions shown by the double-dashed lines, and end edge alignment member 105 is also shifted to the inner position shown by the double-dashed line in FIG. 7(*a*). In this case, end edge alignment member 105 can be shifted. However, if side edge alignment members 103 and 104 are shifted to the inner positions shown by the double-dashed lines, distance D1 between long cavity 102C and empty spaces 102A and 102B should be reduced to D2, which is difficult to design from the view point of strength of sheet stacking member 102. Further, if empty spaces 102A and 102B are increased, it becomes difficult to flatly stack large sized sheets, which results in that the sheets cannot be assuredly conveyed into the image forming apparatus.

To counter the above problem, a sheet supplying cassette for an electro-photographic apparatus which could house small sized sheets, such as post cards, was presented in the Patent Gazette (see Patent Document 1).

According to Patent Document 1, provided are a first sheet supplying cassette to house the various sized sheets such as A3, A4, B4 and B5, and a second sheet supplying cassette to house post card sized sheets. When the sheets A3 to B5 are to be housed, the second sheet supplying cassette can be removed so that A3 to B5 sheets are housed in the first sheet supplying cassette, on the other hand, when post cards are to be housed, the second sheet supplying cassette is installed onto the first sheet supplying cassette so that post cards are housed in the second sheet supplying cassette.

[Patent Document 1] Japanese non-examined Patent Publication No. 11-59925

When the sheet supplying device is structured so as to house not only common sized sheets, such as sizes A3 to B5, but also a smaller size such as post cards, the art shown in Patent Document 1 must employ two sheet supplying cassettes. Thereby, when sheets which are frequently used, are housed, the second sheet supplying cassette is not necessary. Accordingly, a storage facility is necessary in which the second sheet supplying cassette can be kept without being damaged or soiled. Further an operator is required to install the second sheet supplying cassette onto the first sheet supplying cassette, and then to again remove the second sheet supplying cassette from the first sheet supplying cassette, which is troublesome.

SUMMARY OF THE INVENTION

[Item 1] A sheet supplying device, comprising:

a sheet stacking member which can stack various sized sheets;

a side edge alignment member which moves perpendicular to a sheet supplying direction and aligns at least one of side edges of the sheets stacked on the sheet stacking member; and an auxiliary side edge alignment member which is provided on the side edge alignment member and ejects in a moving direction of the side edge alignment member and which aligns stacked sheets whose width is narrower than that of the stacked sheets which are to be aligned by the side edge alignment member.

[Item 2] An image forming system, comprising:

the sheet supplying device in Item 1; and an image forming apparatus to form images on a sheet which is supplied from the sheet supplying device.

BRIEF DESCRIPTION OF THE DRAWINGS

FIG. 7 shows the essential sections of a conventional sheet supplying device.

DETAILED DESCRIPTION OF THE PREFERRED EMBODIMENTS

Embodiments of the sheet supplying device of the present invention will be detailed below, while referring to the above drawings.

Figure 1:
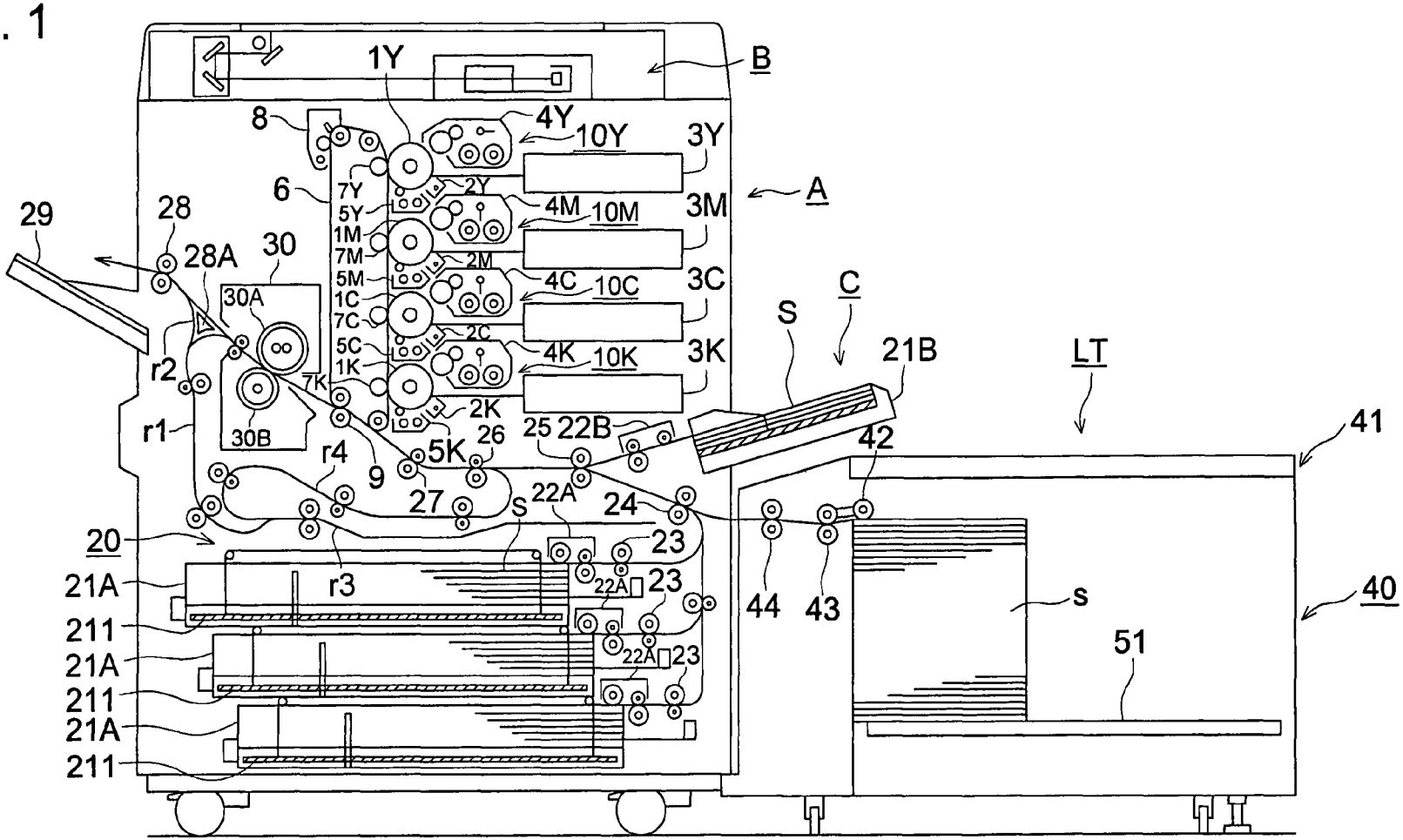
FIG. 1 shows an image forming system structured of an image forming apparatus and a sheet supplying device.

Firstly, to be detailed is an example of the image forming system structured of the image forming apparatus and the sheet supplying device, while referring to FIG. 1.

Image forming apparatus A is represented by a tandem type color image forming apparatus, structured of plural image forming devices 10Y, 10M, 10C and 10K, belt type intermediate transfer device 6, sheet supplying device 20, fixing device 30 and so forth.

Image reading device B is mounted on image forming apparatus A. Images printed on the document mounted on a document platen are exposed by scanning conducted by an optical system of a document image scanning exposure device of image reading device B, and the images are read into a line image sensor. Analog signals, photo-electrically converted by the line image sensor, are conducted in an analog process, A/D conversion, shading correction, and image compression, then the processed signals are inputted into exposure devices 3Y, 3M, 3C and 3K.

Image forming device 10Y to form yellow images includes charging device 2Y, exposure device 3Y, developing device 4Y and cleaning device 5Y, all of which are arranged around photosensitive drum 1Y, serving as an image carrier.

Image forming device 10M to form magenta images includes charging device 2M, exposure device 3M, developing device 4M and cleaning device 5M, all of which are arranged around photosensitive drum 1M, serving as an image carrier.

Image forming device 10C to form cyan images includes charging device 2C, exposure device 3*c*, developing device 4C and cleaning device 5C, all of which are arranged around photosensitive drum 1C, serving as an image carrier.

Image forming device 10K to form black images includes charging device 2K, exposure device 3K, developing device 4K and cleaning device 5K, all of which are arranged around photosensitive drum 1K, serving as an image carrier.

Concerning paired charging device 2Y and exposure device 3Y, paired charging device 2M and exposure device 3M, charging device 2C and exposure device 3C, and paired charging device 2K and exposure device 3K, all pairs structure a latent image forming device.

Developing devices 4Y, 4M, 4C and 4K include a two-component developer, represented by small sized particle toners of yellow (Y), magenta (M), cyan (C) and black (K), as well as a carrier.

Intermediate transfer device 6 is rotated by plural rollers, and supported while rotating.

Each of the colored images, formed by image forming devices 10Y, 10M, 10C and 10K is firstly transferred onto rotating intermediate transfer device 6 by first transfer devices 7Y, 7M, 7C and 7K, whereby color images are generated.

Sheet S, housed in sheet supplying cassette 21A of sheet supplying device 20, is supplied by sheet supplying section 22A, and conveyed to paired image transfer rollers 9 through paired sheet supplying rollers 23, 24, 25 and 26, and paired registration rollers 27, after which color images are secondarily transferred onto sheet S.

Three-staged sheet transfer cassettes 21A, located at the bottom of image forming apparatus A are structured nearly in the same way, and the same number designation is given to equivalent part. Further, three-staged sheet supplying sections 22A are also structured nearly in the same way, and again the same number is given to each equivalent part.

Yet further, sheet supplying device 20 includes sheet supplying cassette 21A and sheet supplying section 22A.

After the color images were transferred onto sheet S, sheet S is nipped by heated roller 30A and pressure roller 30B in fixing device 30, whereby it is heated and pressed. Further, toner images on sheet S are fixed and formed, after which sheet S is nipped by sheet ejection rollers 28 and sent to sheet storage tray 29 outside the apparatus.

On the other hand, after intermediate transfer device 6 transfers a full color image onto sheet S via paired image transfer rollers 9, intermediate transfer device 6 separates sheet S by rotation, after which any remaining toner on intermediate transfer device 6 is removed by cleaning device 8.

When fixed image carrying sheet S is reversed and ejected, sheet S is conveyed through a route which is shown below branching plate 28A placed between fixing device 30 and paired sheet ejection rollers 28 in FIG. 1. After sheet S is conveyed through route r1, sheet S is reversed and passes through route r2 shown to the left of branching plate 28A, after which sheet S is ejected onto sheet storage tray 29 outside the apparatus by paired ejection rollers 28.

When images are to be formed on both surfaces of sheet S, after the image formed on the first surface is fixed, sheet S is conveyed through route r1 and route r3, that is, the surface of sheets S is flipped, after which sheet S is conveyed through route r4 to be circled upward, and further conveyed by paired sheet ejection rollers 28.

Next, images of each color are formed on the second surface of sheet S, which is the reverse surface of the first image carrying surface, and the image on the second surface of sheet S is heat-fixed by fixing device 30, after which sheet S is ejected onto sheet storage tray 29 outside the apparatus by paired ejection rollers 28.

Manual sheet supplying device C is provided integrally but outside of image forming apparatus A. Sheets S, which are housed in sheet supplying tray 21B of manual sheet supplying device C is conveyed by sheet supplying section 22B, and sent to paired image transfer rollers 9 via paired sheet supplying rollers 25 and 26, as well as paired registration rollers 27, so that image formation is conducted on sheet S in the same way as that of the first image carrying surface.

In addition, image forming apparatus A described above is an image forming apparatus to form full color images, but can of course be an image forming apparatus to form monochromatic images.

Bulk sheet supplying device LT, being able to supply a great number of sheets, such as 1,000 sheets, is connected to the right side of image forming apparatus A in FIG. 1. Bulk sheet supplying device LT will now be detailed.

Bulk sheet supplying device LT is structured of main body 40 to house sheets S, and cover 41 which is attached to main body 40, and opened when sheets S are to be loaded. Cover 41 has hinges, which are not illustrated, and provided parallel to the sheet conveyance direction so that main body 40 can be easily opened or closed by cover 41. Main body 40 is provided with pick up roller 42, paired separation rollers 43 and paired conveyance rollers 44.

Sheets S are stacked on sheet stacking member 51. When cover 41 is opened, sheet stacking member 51 is positioned at the bottom, after sheets S are stacked and cover 41 is closed, sheet stacking member 51 is raised by a motor which is not illustrated. When a sensor, also not illustrated, detects the highest sheet S of the stacked sheets, sheet stacking member 51 stops raising, so that highest sheet S is positioned at a predetermined height.

After a sheet supplying signal to supply sheet S is outputted from image forming apparatus A to bulk sheet supplying device LT, pick up roller 42 presses against highest sheet S and begins to rotate, whereupon paired separation rollers 43 pick up individual sheet S, after which paired conveyance rollers 44 convey sheet S into image forming apparatus A. While remaining sheets S become fewer, sheet stacking member 51 continually raises so that highest sheet S is always positioned at the predetermined height.

Further, bulk sheet supplying device LT is able to house various sized sheets, therefore, the side edge alignment member, which is movable to align various but identical sheets in their proper positions, will now be detailed while referring to FIGS. 2-6.

Figure 2:
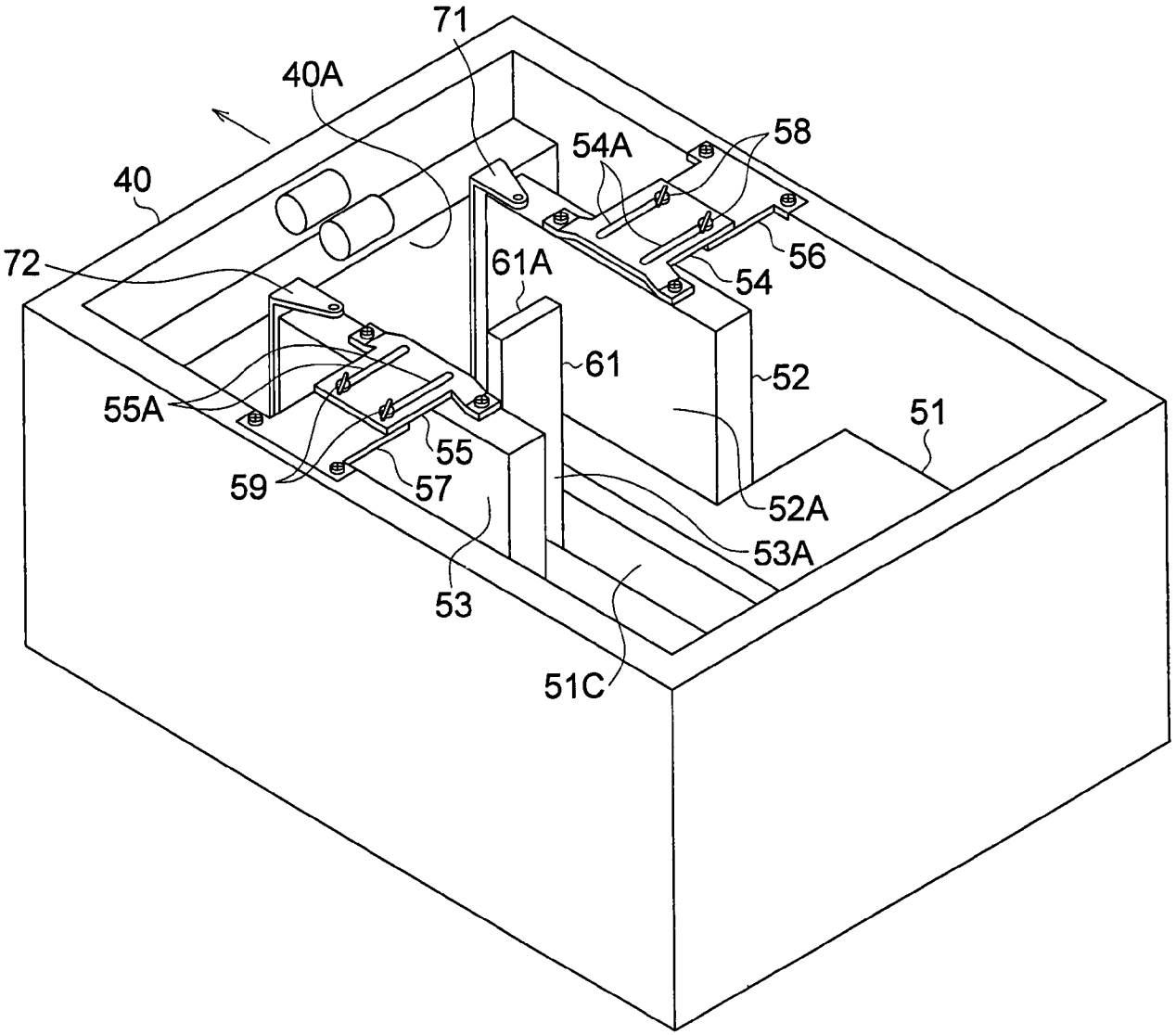
FIG. 2 is a perspective view of a sheet supplying device in which the smallest sized stacked sheets are aligned by the side edge alignment member.
Figure 3:
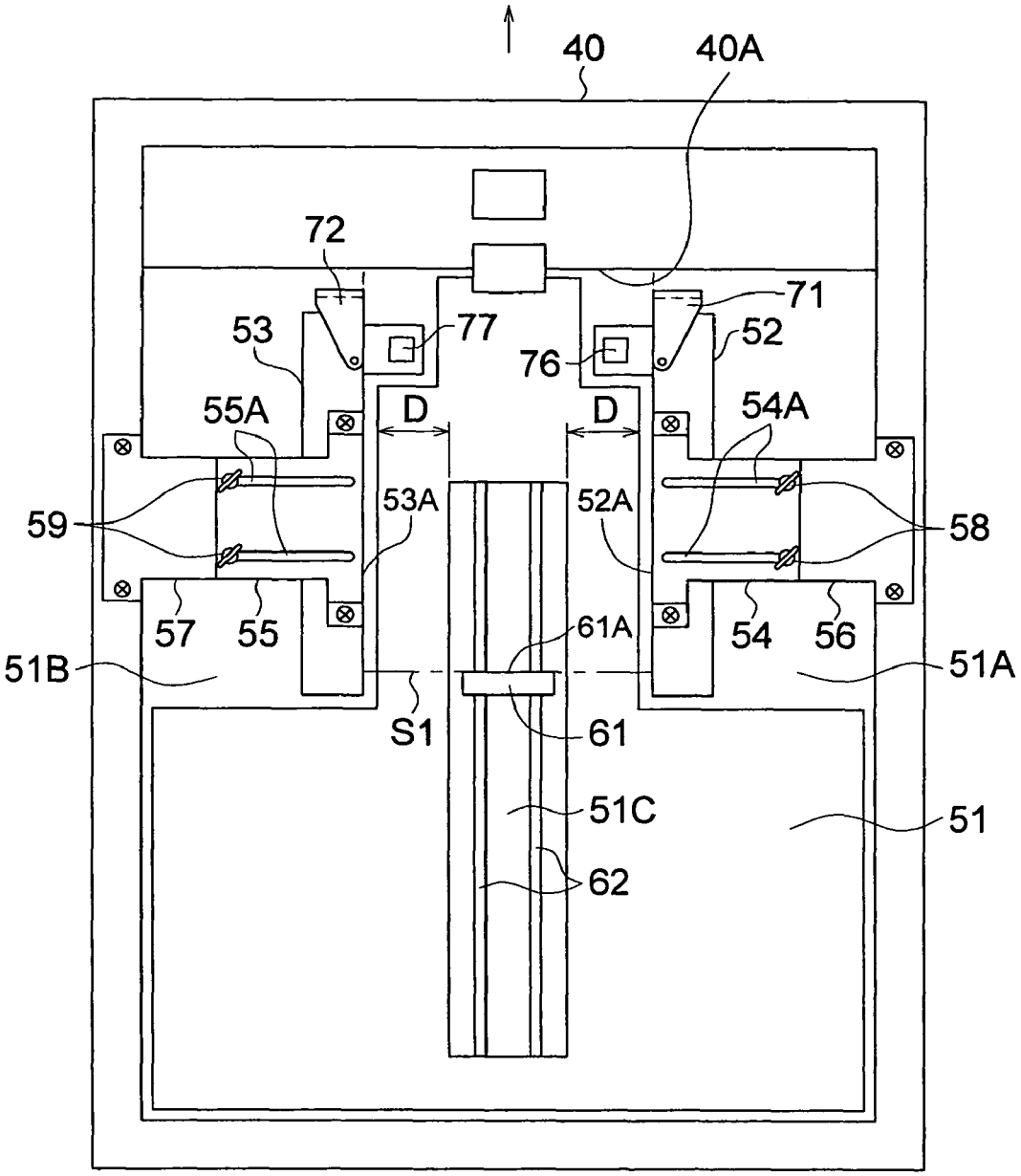
FIG. 3 is a top view of a sheet supplying device in which the smallest sized stacked sheets are aligned by the side edge alignment member.
Figure 4:
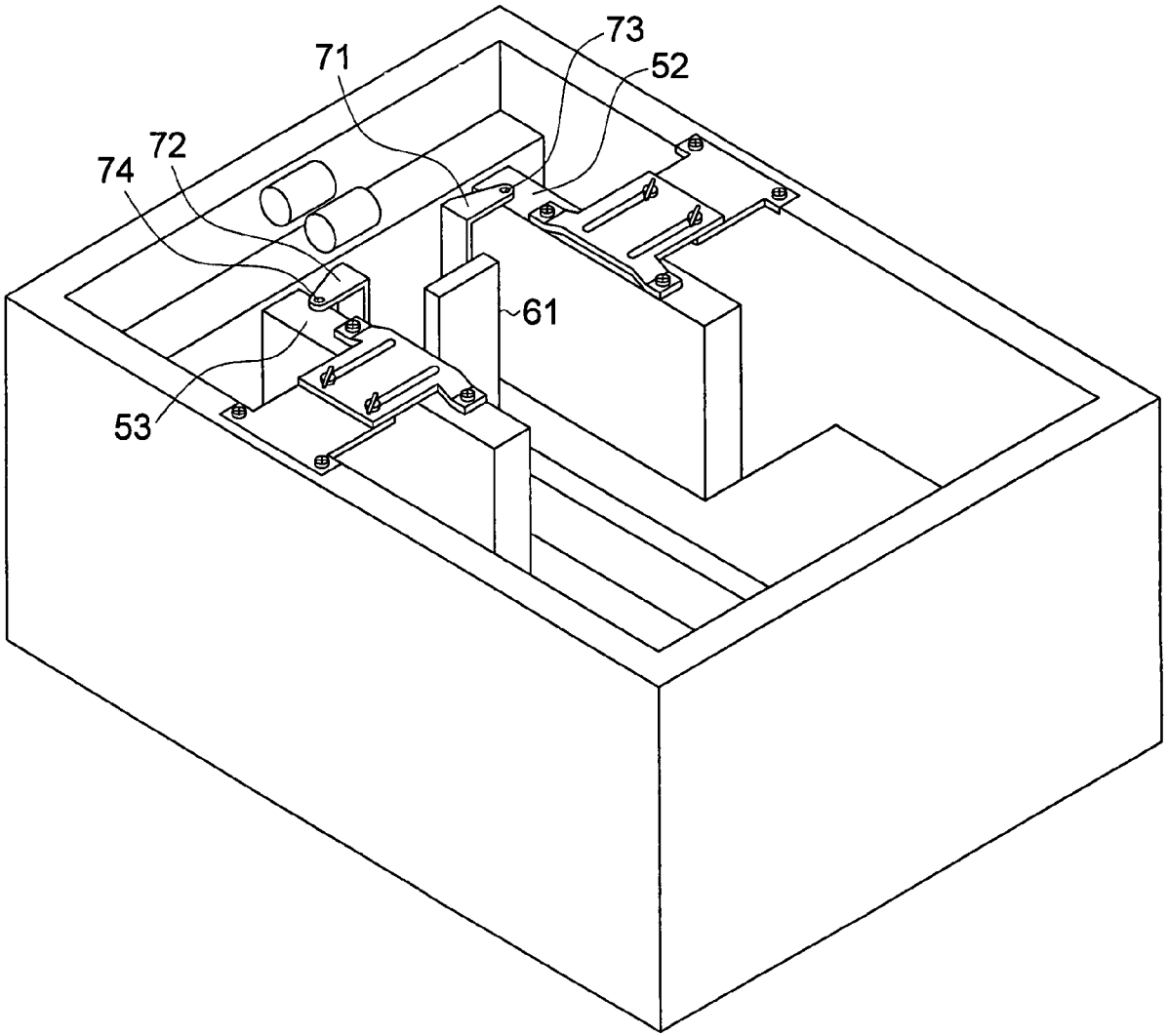
FIG. 4 is a perspective view of a sheet supplying device in which stacked post cards are aligned by the auxiliary side edge alignment member.
Figure 5:
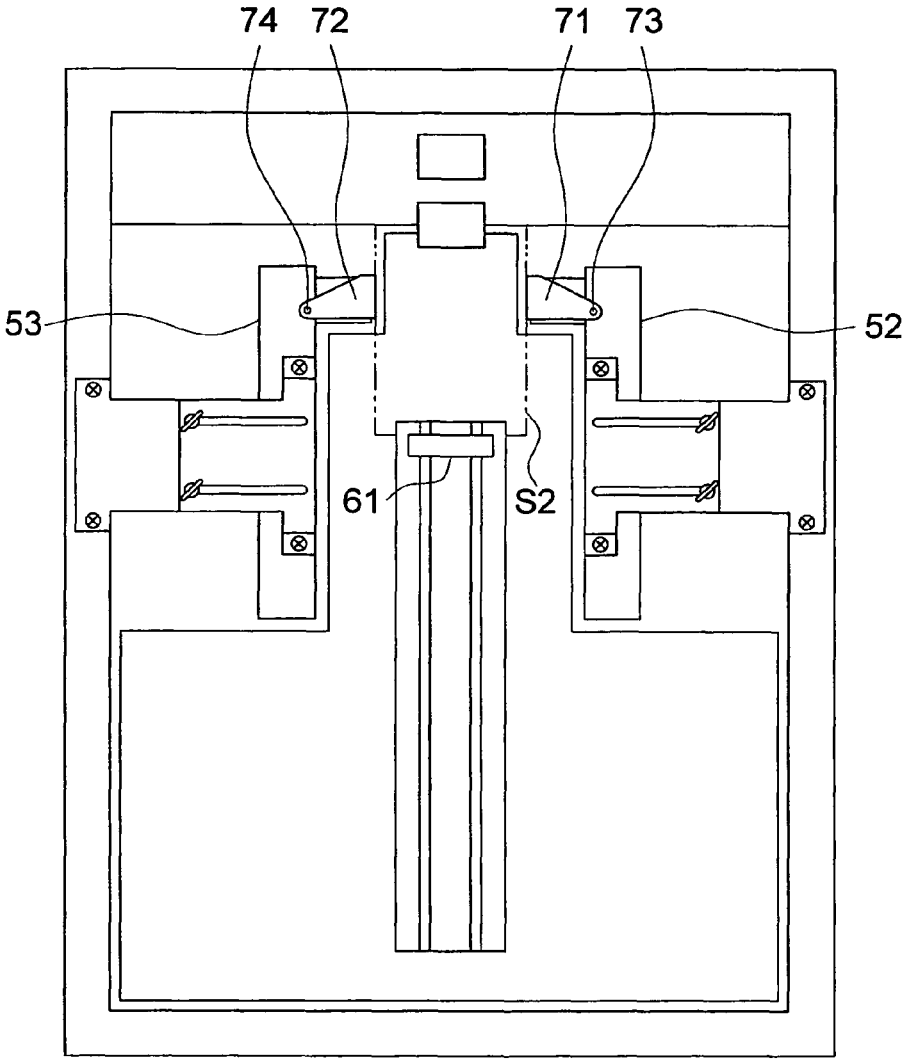
FIG. 5 is a top view of a sheet supplying device in which stacked post cards are aligned by the auxiliary side edge alignment member.
Figure 6:
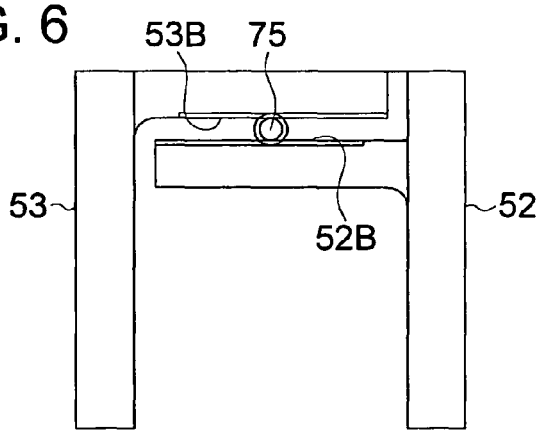
FIG. 6 shows a rack-and-pinion system integrated with the side edge alignment member.

FIG. 2 is a perspective view of the sheet supplying device in which the smallest sized sheets are aligned by the side edge alignment members. FIG. 3 is a top view of the sheet supplying device in which the smallest sized sheets are aligned by the side edge alignment members. FIG. 4 is a perspective view of the sheet supplying device in which postcards are aligned by the auxiliary side edge alignment members. FIG. 5 is a top view of the sheet supplying device in which the smallest sized sheets are aligned by the side edge alignment members. FIG. 6 shows the racks and the pinion provided on the side edge alignment members.

Firstly, the total structure will be detailed referring to FIGS. 2 and 3.

Numeral 51 represents the sheet stacking member, which ascends and descends while carrying blank sheets.

Numerals 52 and 53 represent the side edge alignment members, which eject through large cavities 51A and 51B in FIG. 3, and can be moved by hand perpendicular to the sheet supplying direction (the arrowed direction in FIG. 2) to push the side edges of the sheets. Accordingly, the side edges of the housed sheets are pushed and aligned by interior walls 52A and 53A of side edge alignment members 52 and 53.

Guide plate 54 is mounted on side edge alignment member 52, and fixing plate 56 is mounted on main body 40. Two long holes 54A are structured on guide plate 54. Two butterfly screws 58, each passing through long holes 54A are screwed onto fixing plate 56. Accordingly, after moving side edge alignment member 52 and guide plate 54 perpendicular to the sheet supplying direction, securing them by two butterfly screws 58 at the predetermined position, the operator can fix side edge alignment member 52 using guide plate 54.

By the same way as described above, guide plate 55 is mounted on side edge alignment member 53, and fixing plate 57 is mounted on main body 40. Two long holes 55A are structured on guide plate 55. Two butterfly screws 59 each passing through long holes 55A are screwed onto fixing plate 57. Accordingly, after moving side edge alignment member 53 and guide plate 55 perpendicular to the sheet supplying direction, and securing them by two butterfly screws 59 at the predetermined position, the operator can fix side edge alignment member 53 using guide plate 55.

Further, the leading top edges of the housed sheets are pushed toward interior wall 40A of main body 40 and aligned.

On the other hand, the ends of the housed sheets are pushed by interior wall 61A of end alignment plate 61, which stands through long cavity 51C provided on sheet stacking member 51 and is moved by hand, so that the sheets are aligned in the sheet supplying direction. In addition, end alignment plate 61 is guided by two guide shafts 62 in FIG. 2, and can move in the sheet supplying direction. End alignment plate 61 is positioned at a predetermined position by a locking mechanism, which is not illustrated.

That is, the right side edges of the sheets are aligned by interior wall 52A of side edge alignment member 52, while the left side edges of the sheets are aligned by interior wall 53A of side edge alignment member; 53. The leading top edges of the sheets are aligned by interior wall 40A of main body 40, while the ends of the sheets are aligned and positioned by interior wall 61A of end alignment plate 61.

Accordingly, by moving side edge alignment members 52 and 53, as well as end edge alignment member 61, the operator can position various sized sheets on bulk sheet housing device LT, such as longitudinal A3 (width: 297 mm, feeding direction length: 420 mm), lateral A4 (width: 297 mm, feeding direction length: 210 mm), longitudinal B4 (width: 257 mm, feeding direction length: 364 mm), lateral B5 (width: 257 mm, feeding direction length: 182 mm), longitudinal A4 (width: 210 mm, feeding direction length: 297 mm), and longitudinal B5 (width: 182 mm, feeding direction length: 257 mm).

However, if the sheet supplying device is designed to house small sized sheets, such as post cards (width: 102 mm, feeding direction length: 148 mm), or very narrow envelopes, by the same method as described above, distance D between long cavity 51C of sheet stacking member 51 and cavities 51A and 51B becomes so small that mechanical strength can not be satisfied.

To overcome this problem, firstly, side edge alignment members 52 and 53 are shifted to the position where the smallest sheet S1 (longitudinal B5, for example) is aligned by side edge alignment members 52 and 53 as shown in FIG. 3. Next, auxiliary side edge alignment members 71 and 72 are rotated from side edge alignment members 52 and 53 shown in FIGS. 4 and 5, and thereby it becomes possible to align small sized sheet S2, such as longitudinal post cards by auxiliary side edge alignment members 71 and 72. In this case, end alignment plate 61 is also shifted to align the ends of sheets S2.

The vertical length of auxiliary side edge alignment members 71 and 72 is designed in such a way that they align all sheets from the lowest sheet to the highest sheet of stacked sheets S2 stacked on sheet stacking member 51. When sheets S2 are stacked, auxiliary side edge alignment member 71 is rotated counterclockwise around shaft 73 by hand, while auxiliary side edge alignment member 72 is rotated clockwise around shaft 74 by hand. As seen in FIG. 4, shafts 73, 74 are perpendicular to the sheet supplying direction.

Accordingly, when small sized sheets S2, such as post cards, are not used, auxiliary side edge alignment members 71 and 72 are returned to the positions shown in FIGS. 2 and 3, while when small sized sheets S2 are used, auxiliary side edge alignment members 71 and 72 are rotated to the positions shown in FIGS. 4 and 5. In addition, since magnets, which are not illustrated, are provided on auxiliary side edge alignment members 71 and 72, the magnets attract the other magnets which are provided on both the waiting positions and the rotated positions, which are also not illustrated. Accordingly, auxiliary side edge alignment members 71 and 72 are positively secured at two positions. Additionally, in order to fix auxiliary side edge alignment members 71 and 72 at the two positions, a clicking mechanism including a small ball and a coiled spring may also be used.

Further, instead of rotating auxiliary side edge alignment members 71 and 72, a sliding method to slide auxiliary side edge alignment members 71 and 72 toward the interior may also be used.

As detailed above, by structuring auxiliary side edge alignments members 71 and 72 which can project from side edge alignment members 52 and 53, not only common sizes, such as A4 size, but also very small sizes, such as post cards, can be easily handled, without manually changing the sheet supplying cassette, as in the conventional art.

In FIG. 6, racks 52B and 53B are provided under side edge alignment members 52 and 53, so that racks 52B and 53B engage pinion 75 provided on main body 40. Accordingly, if side edge alignment member 52 is moved by hand, side edge alignment member 53 is automatically driven in the opposite direction, and vise versa. By providing a potentiometer (being a first detecting device), represented by a variable resistor which is not illustrated, it is possible to detect the positions of side edge alignment members 52 and 53, by which the size of the stacked sheets is detected, and detected information is sent to image forming apparatus A.

Further, as shown in FIG. 3, photo-sensors 76 and 77 (being second detecting devices) are provided on sections which move with side edge alignment members 52 and 53, and are located below the ejected position of auxiliary side edge alignment members 71 and 72. Photo-sensors 76 and 77 detect whether auxiliary side edge alignment members 71 and 72 are set at the correct ejecting positions. Accordingly, when auxiliary side edge alignment members 71 and 72 are rotated, and the small sized sheets, such as post cards, are stacked, the sheets supplying device can determine that the small sized sheets have been housed, using information from photo sensors 76 and 77. Then, information from photo sensors 76 and 77 is sent to image forming apparatus A.

In addition, wherever side edge alignment members 52 and 53 may be positioned, auxiliary side edge alignment members 71 and 72 can be rotated to the ejecting positions. That is, concerning the width of the sheets, from the post cards width to the smallest sheet width which can be aligned by side edge alignment members 52 and 53, any intermediate width of the sheets can be aligned by auxiliary side edge alignment members 71 and 72. Further, since photo sensors 76 and 77 are structured so as to move with side edge alignment members 52 and 53, it can be determined whether auxiliary side edge alignment members 71 and 72 are at the ejecting positions, independent to the positions of side edge alignment members 52 and 53. Accordingly, by using the detected results of photo sensors 76 and 77, and the detected result of the potentiometer to detect the position of side edge alignment members 52 and 53, any size of stacked sheets S2 can be determined, under the condition that the size is greater than post cards size.

The sheet supplying device described above includes two side edge alignment members. If one of them is moved, the other moves in the opposite direction, and thereby various sized sheets can be positioned with their center positions being not changed. However, a structure can be available in that by using a single side edge alignment member, one of the side edges can be aligned by the side edge alignment member, while the other side edge is in contact with the interior wall of the main body. In this case, a single auxiliary side edge alignment member can also be used.

In addition, since the side edge alignment member, including the auxiliary side edge alignment member described above, can be used in sheet supplying cassette 21A in FIG. 1, the sheet supplying device of the present invention includes such sheet supplying cassette.

Further, these side edge alignment members are not to be limited to the racks and pinion structure, for example, the side edge alignment members can be driven by a cranking mechanism.

Still further, the auxiliary side edge alignment members are not to be limited to the structure wherein the auxiliary side edge alignment members are set in the two positions, being the waiting position and the ejecting position, but also available is the structure wherein an ejecting position can be selected from plural ejecting positions.

What is claimed is:

1. A sheet supplying device for use with an image forming apparatus, the sheet supplying device comprising:

a sheet stacking surface which stacks various sized sheets;

a side edge alignment member which moves in a width direction of a sheet being perpendicular to a sheet supplying direction of the sheets stacked on the sheet stacking surface and aligns at least one of side edges of the sheets stacked on the sheet stacking surface; and an auxiliary side edge alignment member which is rotatably mounted around a shaft vertically arranged on the side edge alignment member and is ejectable in a moving direction of the side edge alignment member to align the sheets stacked on the sheet stacking surface, the auxiliary side edge alignment member comprising a U-shaped structure and contacting a top surface and a bottom surface of the side edge alignment member;

wherein the shaft is perpendicular to the sheet supplying direction, and the width of the sheets to be aligned by the auxiliary side edge alignment member is narrower than that of the various sized sheets which are to be aligned by the side edge alignment member;

wherein in a case that the side edge alignment member aligns the stacked sheets, the auxiliary side edge alignment member is retracted to the exterior of a downstream portion of the side edge alignment member, with respect to the sheet supplying direction; and wherein the sheets stacked on the sheet stacking surface are aligned by the side edge alignment member or the auxiliary side edge alignment member.

2. The sheet supplying device in claim 1, further including a first detector structured to detect a position of the side edge alignment member;

wherein the first detector is structured to communicate the detected position to the image forming apparatus.

3. The sheet supplying device in claim 1, further including a second detector structured to detect that the auxiliary side edge alignment member is set at an ejected position;

wherein the second detector is structured to communicate information from the second detector to the image forming apparatus.

4. The sheet supplying device in claim 3, wherein the second detector moves with the side edge alignment member.

5. The sheet supplying device in claim 1, further including an end edge alignment member which aligns the end edge of the stacked sheets in the sheet supplying direction and which moves in parallel to the sheet supplying direction.

6. The sheet supplying device in claim 1, wherein the sheet stacking surface goes up while maintaining an almost horizontal condition depending on remaining amount of the sheets.

7. An image forming system, comprising:

a sheet supplying device comprising:

a sheet stacking surface which stacks various sized sheets;

a side edge alignment member which moves in a width direction of a sheet being perpendicular to a sheet supplying direction of the sheets stacked on the sheet stacking surface and aligns at least one of side edges of the sheets stacked on the sheet stacking surface; and an auxiliary side edge alignment member which is rotatably mounted around a shaft vertically arranged on the side edge alignment member and is ejectable in a moving direction of the side edge alignment member to align the sheets stacked on the sheet stacking surface, the auxiliary side edge alignment member comprising a U-shaped structure and contacting a top surface and a bottom surface of the side edge alignment member;

wherein the shaft is perpendicular to the sheet supplying direction, and the width of the sheets to be aligned by the auxiliary side edge alignment member is narrower than that of the various sized sheets which are to be aligned by the side edge alignment member;

wherein in a case that the side edge alignment member aligns the stacked sheets, the auxiliary side edge alignment member is retracted to the exterior of a downstream portion of the side edge alignment member, with respect to the sheet supplying direction; and wherein the sheets stacked on the sheet stacking surface are aligned by the side edge alignment member or the auxiliary side edge alignment member; and an image forming apparatus to form images on a sheet which is supplied from the sheet supplying device.

8. The image forming system in claim 7, further including a first detector structured to detect a position of the side edge alignment member;

wherein the first detector is structured to communicate the detected position to the image forming apparatus; and the image forming system determines a size of the sheets stacked in the sheet supplying device, based on a detected result of the first detector.

9. The image forming system in claim 7, further including a second detector structured to detect that the auxiliary side edge alignment member is set at an ejected position;

wherein the second detector is structured to communicate a detected result from the second detector to the image forming apparatus; and the image forming system determines a size of the sheets stacked in the sheet supplying device, based on the detected result of the second detector.

* * * * *